US006338349B1

(12) United States Patent
Robinson et al.

(10) Patent No.: US 6,338,349 B1
(45) Date of Patent: Jan. 15, 2002

(54) METHOD AND SYSTEM FOR PROVIDING CUSTOMIZED COLOR COSMETICS

(75) Inventors: Andrea Robinson; Jeanine Recckio, both of New York, NY (US); Curtis F. Altmann, Darien, CT (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/466,530

(22) Filed: Dec. 17, 1999

Related U.S. Application Data

(60) Provisional application No. 60/112,958, filed on Dec. 18, 1998.

(51) Int. Cl.[7] ..... A45D 33/24
(52) U.S. Cl. ..... 132/200; 434/100; 132/294
(58) Field of Search ..... 434/99, 100, 103; 132/200, 294, 295, 296, 297, 333

(56) References Cited

U.S. PATENT DOCUMENTS 1,767,567 A * 6/1930 Weil ..... 132/294
3,851,655 A * 12/1974 Tarro ..... 132/294
4,807,773 A * 2/1989 Tsai ..... 132/296
4,815,483 A * 3/1989 DuGrenier et al. ..... 132/295
5,236,365 A * 8/1993 Badami ..... 132/294
5,311,293 A * 5/1994 MacFarlane et al. ..... 434/100
5,520,203 A * 5/1996 Segerstrom ..... 132/297
5,813,420 A * 9/1998 Sussman ..... 132/294
5,941,255 A * 8/1999 Chen ..... 132/294
6,000,407 A * 12/1999 Galazin ..... 132/200

OTHER PUBLICATIONS

Trish McEnvoy System, color photographs (2 views), 1 page.
Z–CARD®, Tommy Hilfiger, "play as you go", color advertising brochure, 2 pages.

* cited by examiner

*Primary Examiner*—Todd E. Manahan
(74) *Attorney, Agent, or Firm*—Baker Botts L.L.P.

(57) ABSTRACT

A method and system are provided for allowing a customer to sample and select a customized cosmetic product, including a matrix representing different components and/or types of color, texture and applicators to allow the customer to sample at the point of sale a myriad of customized cosmetic products. Also provided is a system by which a customer can generate customized products by using one of a plurality of pure pigment color sticks together with one of a plurality of texturizers for producing a desired texturized product which can be applied with one of a plurality of applicators to achieve a desired customized color cosmetic product having a distinctive look.

4 Claims, 1 Drawing Sheet

METHOD AND SYSTEM FOR PROVIDING CUSTOMIZED COLOR COSMETICS

CLAIM OF PRIORITY

This application stems from and claims the benefit of provisional application Serial No. 60/112,958 filed on Dec. 18, 1998.

FIELD OF THE INVENTION

The present invention relates to a method and system for sampling, selecting and providing a user specified color cosmetic, and more particularly to a customization system for providing a customized color cosmetic based upon several factors including but not limited to pigment, texture finish and the type of applicator to be used in applying the cosmetic to the body and preferably the face to achieve a variety of looks. One color, therefore, could be used, for example, for application to different parts of the face.

BACKGROUND OF THE INVENTION

Color cosmetics have a long history as traditional products developed and marketed specifically to provide color not only to the face (as a foundation or as "makeup") but also to the cheeks as blush, to the eyes as eye shadows, eyeliners, brow colors, and mascara, and to the lips as lipsticks and lip definers. These products are provided with their own color and texture (e.g., shiny, matte, metallic, etc.) specific to their formulation.

A consumer shops the wide array of marketers of these products to get the color and texture they desire. Consumers may disadvantageously identify the color they desire, but not the texture they require. Consumers may also identify the color, or color and texture they desire for their eyes, but it exists only in a lipstick. Consumers may also identify a color and texture, but not be able to attain the type of ultimate finish desired (e.g., by brush). The difficulty of providing the right combinations to the marketplace is exacerbated by the fact that so many exist and that color and texture in cosmetics, and overall styles and looks in general, change and evolve constantly over time.

SUMMARY OF THE INVENTION

The present invention provides a comprehensive system to best allow the consumer to sample and select the color and texture desired for a particular application. More specifically, the present invention provides a unique customization system which allows the consumer to sample and select a customized color cosmetic product based upon several factors including but not limited to pigment, texture, and applicator.

In a preferred embodiment, a matrix is provided at the point of sale which breaks down the traditional product offerings into discrete categories and separates the basic elements of color, texture and applicator. Preferably, one column of the matrix identifies and provides pigments or colors that are wearable alone as cosmetic color for the face, cheeks, eyes or lips or body. At another column are mediums of texture that are wearable alone or can be combined with, or applied over, the color to transform the color and enhance its effect. Either or both of the color and texture can be applied with or without the aide of an applicator, provided in a third column, that can additionally enhance the end effect. This matrix of color, texture and applicator greatly increases and enhances the choice and individual customization of the consumer to achieve a desired look.

This concept proposes that there are three basic elements in the offering-color, texture medium (transformer), and applicators. In this way, traditional product segments such as foundations, concealers, blush, eye shadows, eye highlighters, eyeliners, brow colors, mascara, lipsticks, lip glosses and lip definers, for example, are replaced by these three basic elements. In addition, the three elements are provided in a variety of components so as to enable customized combination on the face or body through the process of application or combination prior to application.

In another preferred embodiment, the pure pigment color is provided or sold to the consumer in a fat or thin stick having a color preferably depicted in or chosen from the first column of the matrix. This color product is intended to be applied to any part of the body or face and is specifically intended to replace the traditional foundation, concealer, lipstick, eye shadow, blush, or any other of the one-dimensional, dedicated products mentioned above. The consumer then is provided with or sold a "texturizer" in the form of a tube or roller, which comes in different textures or finishes including sheer, glossy, creamy, matte, metallic, etc., all preferably represented in or chosen from the second column of the matrix. A third factor is the type of applicator which is to be used in applying the cosmetic to the body or face, such as a brush, sponge or paddle. Preferably, this can be selected from the third column of the matrix.

Accordingly, by applying the stick and texturizer with a particular application the customer can achieve a customized look. No longer must the customer buy several different products to achieve several different looks; rather, with the present invention, with the purchase of a few products, many different customized looks can be achieved.

In addition, two pigments can be used together to form another color (likewise for the transformer). The multiples of colors and looks are endless and at the discretion of the consumer.

The foregoing and other further advantages and objects of the present invention will be apparent to those skilled in the art in view of the description of the preferred embodiments taken together with the appended claims and the accompanying drawings.

DETAILED DESCRIPTION OF THE PREFERRED EMBODIMENTS

Figure 1:
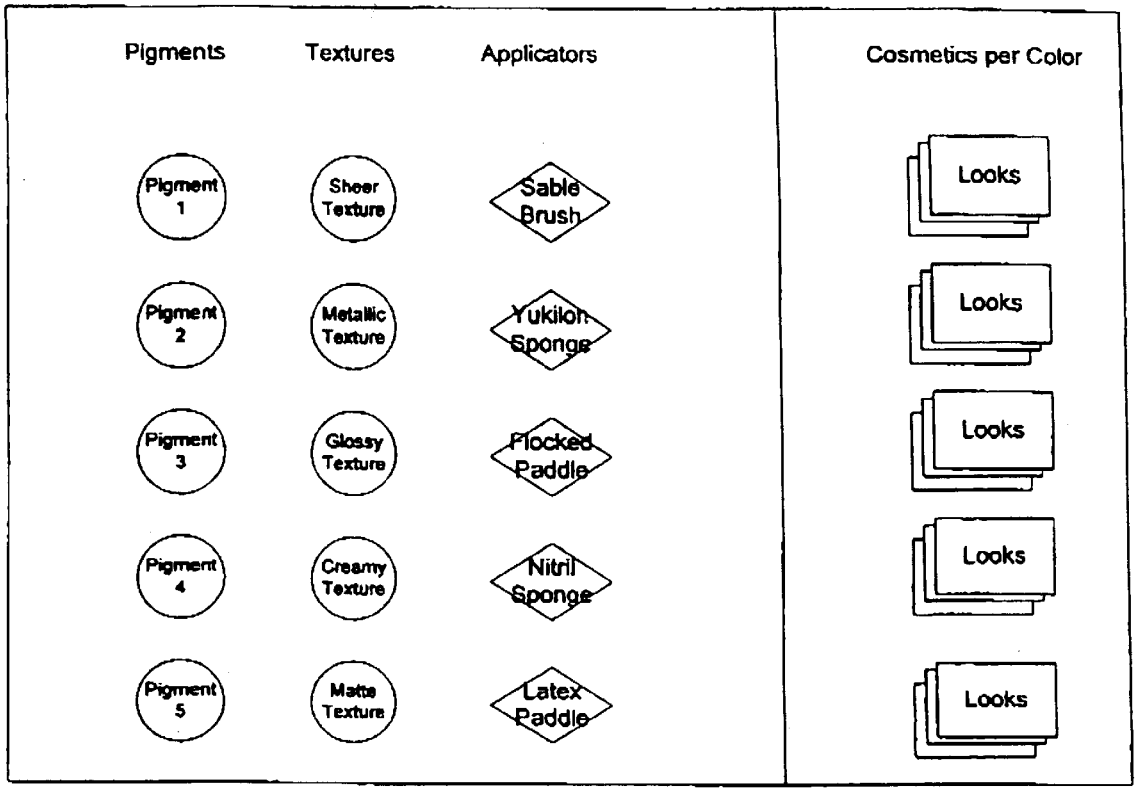
FIG. 1 is a schematic representing a preferred matrix of the present invention.

FIG. 1 schematically depicts a sample matrix of color (pigments), texture medium (texturizer), and applicators. Each column represents a different category of a cosmetic product offering, such as pigments, textures and applicators. The rows represent a component of each such category.

As for pigments, the components comprise an infinite variety of colors, including, for instance, pigment 1 to pigment 5.

The components of textures, presented by use of a texturizer preferably in the form of a tube or roller, include sheer, metallic, glossy, creamy, matte and may also include another color, sparkle effect, or opalescent, bronzing, demi-matte, photocromic, wet, glow in the dark, etc. In addition, the texturizer can be made to have skin care and treatment benefits such as providing moisturizing, anti-aging, sun protection, vitamins and more.

The components of applicators include different types of brushes, sponges, and paddles, including natural and synthetic sponges, natural and synthetic fabrics as well as natural and synthetic brushes. They can also include sterilizable and disposable brushes for use around sensitive areas such as the eye. For example, one-time use brushes can be provided for applying color and texture for use as mascara.

It should be understood that the objective is for any color to be used with any texturizer and/or any applicator, to achieve a desired cosmetic effect, or look. It should also be understood that any texturizer can be used with any applicator to achieve a desired effect, or look. Finally, it should be understood that any color or texturizer or applicator could be used alone to achieve a desired cosmetic effect, or look.

Figure 2:
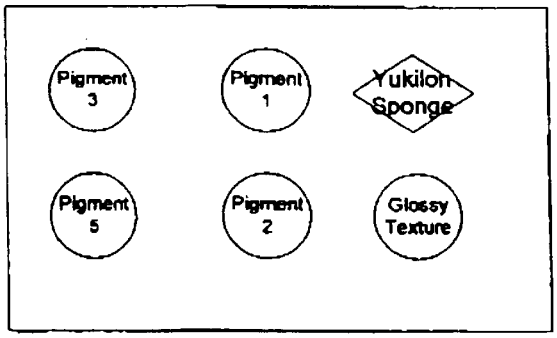
FIG. 2 is a schematic representing a customized compact provided in accordance with the present invention.

The cosmetic matrix depicted in FIG. 1 could be marketed in numerous ways. For example, if an entire matrix were provided at a retail counter, consumers could build their own compact by selecting color(s), texturizer(s) and/or applicator(s) of choice. For instance, as shown in FIG. 2, a cosmetic compact is provided with four different colors, pigments 1, 2, 3 and 5, one texturizer ("glossy texture"), and one applicator, a yukilon sponge. In this manner, the consumer can use the sponge to apply a glossy texture of four different pigments to the body.

Figure 3:
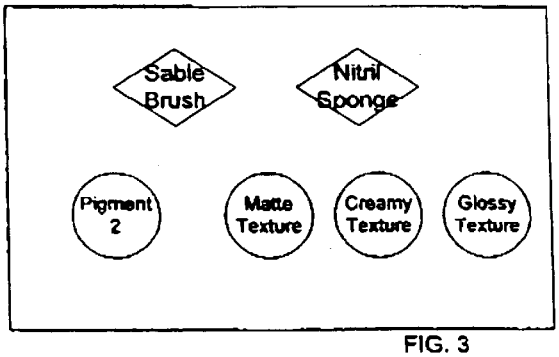
FIG. 3 is a schematic representing a customized compact provided in accordance with the present invention.

Alternatively, as shown in FIG. 3, consumers could select one desired color which comes packaged with three texturizers and two applicators, so that the desired color may be used in different ways. In this regard, each color may have several ready packages of texturizer(s)/applicator(s).

Accordingly, the foregoing description of the preferred embodiments should be considered as merely illustrative of the present invention and not in limitation thereof. The present invention is defined solely by the claims which follow.

We claim:

1. A system for providing to a customer a customized color cosmetic having a certain look, comprising:

a plurality of sticks each having one of a plurality of pure pigment color products;

one or more of a plurality of texturizers each for providing one of a plurality of different textures to said one of said plurality of pure pigment color products, and for producing a texturized product;

an applicator for applying said texturized product to the body to achieve said look of said customized color cosmetic.

2. The system of claim 1, wherein said plurality of different textures includes sheer, metallic, glossy, creamy and matte.

3. A method for providing to a customer a customized color cosmetic each having a certain look, comprising:

supplying said customer with one of a plurality of sticks each having one of a plurality of pure pigment color products;

supplying said customer with one of a plurality of texturizers for application to said one of a plurality of pure pigment color products, to give said product one of a plurality of textures and to produce a texturized product, wherein said customer is provided with a customized color cosmetic product capable of creating a certain look.

4. The method of claim 3, further comprising the step of:

providing to said customer one of a plurality of applicators for applying said texturized product to said body.

* * * * *